US005906314A

United States Patent [19]

Kinay

[11] Patent Number: 5,906,314

[45] Date of Patent: May 25, 1999

[54] WINDPROOF ASHTRAY

[76] Inventor: Ismail Kinay, Telsiz Mah. 72.Sokak No.:17/12, Zeytinburnu 34760, Istanbul, Turkey

[21] Appl. No.: 09/030,620

[22] Filed: Feb. 27, 1998

[51] Int. Cl.[6] ..... B65D 91/00

[52] U.S. Cl. ..... 232/43.1; 131/235.1; 131/237; 131/242

[58] Field of Search ..... 232/43.1, 43.2, 232/43.3, 43.4, 43.5; 131/235.1, 256, 237, 242, 240.1; 220/502

[56] References Cited

U.S. PATENT DOCUMENTS

| | | | |
|---|---|---|---|
| 1,710,957 | 4/1929 | Woller . | |
| 1,910,988 | 5/1933 | Grunwald . | |
| 2,145,055 | 1/1939 | Reichenbach . | |
| 2,340,618 | 2/1944 | Schiszler . | |
| 2,494,979 | 1/1950 | Worthing . | |
| 2,520,746 | 8/1950 | Uman . | |
| 2,582,109 | 1/1952 | Fee . | |
| 2,595,103 | 4/1952 | Schmaling, Jr. . | |
| 2,867,221 | 1/1959 | Farley . | |
| 2,936,765 | 5/1960 | Talkington . | |
| 2,973,879 | 3/1961 | Darst . | |
| 3,522,812 | 8/1970 | Chism et al. . | |
| 3,871,387 | 3/1975 | Busse . | |
| 4,331,164 | 5/1982 | Bodenmann . | |
| 4,534,370 | 8/1985 | Saxby . | |
| 4,548,217 | 10/1985 | Saculla . | |
| 4,726,513 | 2/1988 | Wolfe | 232/43.1 |
| 5,535,762 | 7/1996 | Li . | |
| 5,601,096 | 2/1997 | Lin . | |

*Primary Examiner*—Brian K. Green
*Assistant Examiner*—William L. Miller
*Attorney, Agent, or Firm*—Michael I. Kroll

[57] ABSTRACT

A windproof ashtray (10) comprising a main body (12) for receiving cigarette ashes and cigarette butts therein. A top portion (14) is on the main body (12). A base (16) is for stabilizing the main body (12) upon a support surface (18). A structure (20) in the top portion (14) is for guiding cigarette ashes deposited therein into main body (12), while preventing the cigarette ashes from being blown out.

12 Claims, 3 Drawing Sheets

Fig. 1
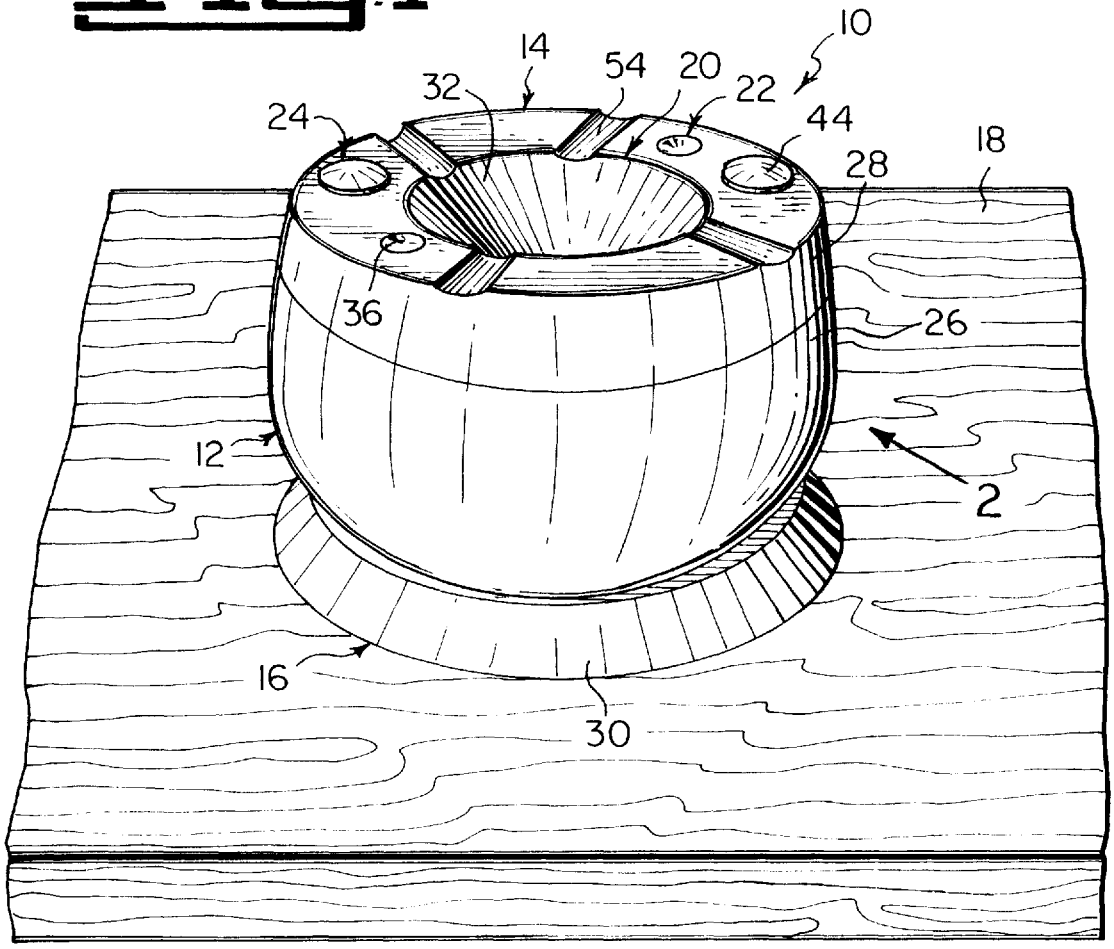
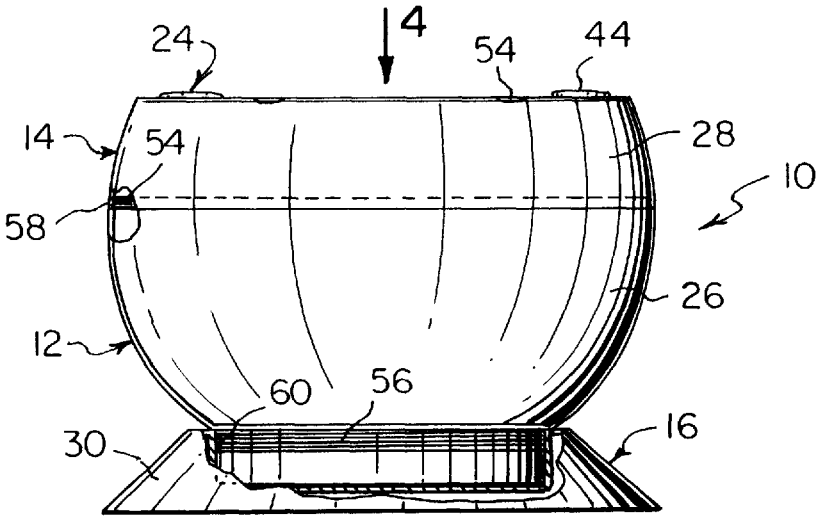
Fig. 2

WINDPROOF ASHTRAY

BACKGROUND OF THE INVENTION

1. Field of the Invention

The instant invention relates generally to cigarette extinguishers and more specifically it relates to a windproof ashtray. The windproof ashtray will prevent any cigarette ashes deposited therein from being blown out by the wind and contains at least one structure for extinguishing a burning end of a cigarette and depositing it therein.

2. Description of the Prior Art

Numerous cigarette extinguishers have been provided in prior art. For example, U.S. Pat. Nos. 2,936,765 to Talkington; 3,522,812 to Chism; 3,871,387 to Busse and 4,548,217 to Saculla all are illustrative of such prior art. While these units may be suitable for the particular purpose to which they address, they would not be as suitable for the purposes of the present invention as heretofore described.

A cigarette extinguisher comprising an ash tray including opposed side walls. A bar is mounted horizontally in the tray on the side walls. The bar has a circular opening therein. A tapered receptacle for extinguishing the burning end of the cigarette is mounted in the opening and depends from the bar. A flange on the upper end of receptacle is engaged on the bar. A bracket is on the lower portion of the receptacle. A plunger is slideable in the bar and bracket. A closure for the lower end of the receptacle is fixed on the plunger. A coil spring engaged with the bracket is for securing the receptacle in the opening and is operatively connected to the plunger for actuating same for engaging the closure with the receptacle.

A flat-bottomed can provides a self-standing receiver. The top of the can has an upstanding screw-threaded neck for a screw cap having a lid portion that is centrally apertured and embodies a truncated conical adapter into which the depending discharge neck of an upstanding funnel is secured. A coiled spring atop the funnel provides cigarette seating and gripping members so that ashes, butts and refuse gravitate and accumulate in the receiver for emptying and disposition.

The ashtray comprises a housing and a U-shaped insert inserted into the housing. An upper portion of one side of the insert is included downwardly and an upper portion of the opposite side is bent first inwardly and then upwardly to form a fulcrum edge. A balance-like cover member is loosely supported on the fulcrum edge and one arm thereof is operable to abut from below against the edge of the downwardly sloping side portion whereas the other arm is provided with a weight urging the one arm into a gap closing position. The one arm is preferably provided with a U-shaped attachment forming together with the sloping side a cigarette butt extinguishing chamber.

Herein disclosed is a compact, highly attractive combination cigarette extinguisher and ashtray. The device comprises a body portion of generally cylindrical formation adapted to be supported on a table top, desk or the like with its axis vertical. The peripheral wall of the body provides a plurality of vertically-extending recesses each adapted to receive a cigarette butt with the lighted end of the latter downward. A cap fits over the upper portion of the body and is rotatable to align an opening in the cap with a selected one of the vertically-extending recesses to permit deposit of a cigarette butt in such recess. The cap is then rotated to close off the recess and the light on the butt is quickly extinguished. A filter element is disposed between the upper surface of the body and the inner surface of the cap, to restrict passage of the odor of the extinguished butt from passing into the room in which the combination cigarette extinguisher and ashtray is disposed.

SUMMARY OF THE INVENTION

A primary object of the present invention is to provide a windproof ashtray that will overcome the shortcomings of the prior art devices.

Another object is to provide a windproof ashtray that contains a central funnel ash receiver which guides cigarette ashes into a main body, which will prevent any of the cigarette ashes deposited therein from being blown out by the wind.

An additional object is to provide a windproof ashtray that has at least one structure for extinguishing a burning end of a cigarette and depositing the cigarette butt into the main body.

A further object is to provide a windproof ashtray that is simple and easy to use.

A still further object is to provide a windproof ashtray that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view of the present invention placed upon a support surface.

FIG. 2 is an elevational view of the present invention per se taken in the direction of arrow 2 in FIG. 1, with parts broken away and in section.

Similar reference characters denote corresponding features consistently throughout the attached drawings.

DETAILED DESCRIPTION OF THE PREFERRED EMBODIMENTS

Figure 3:
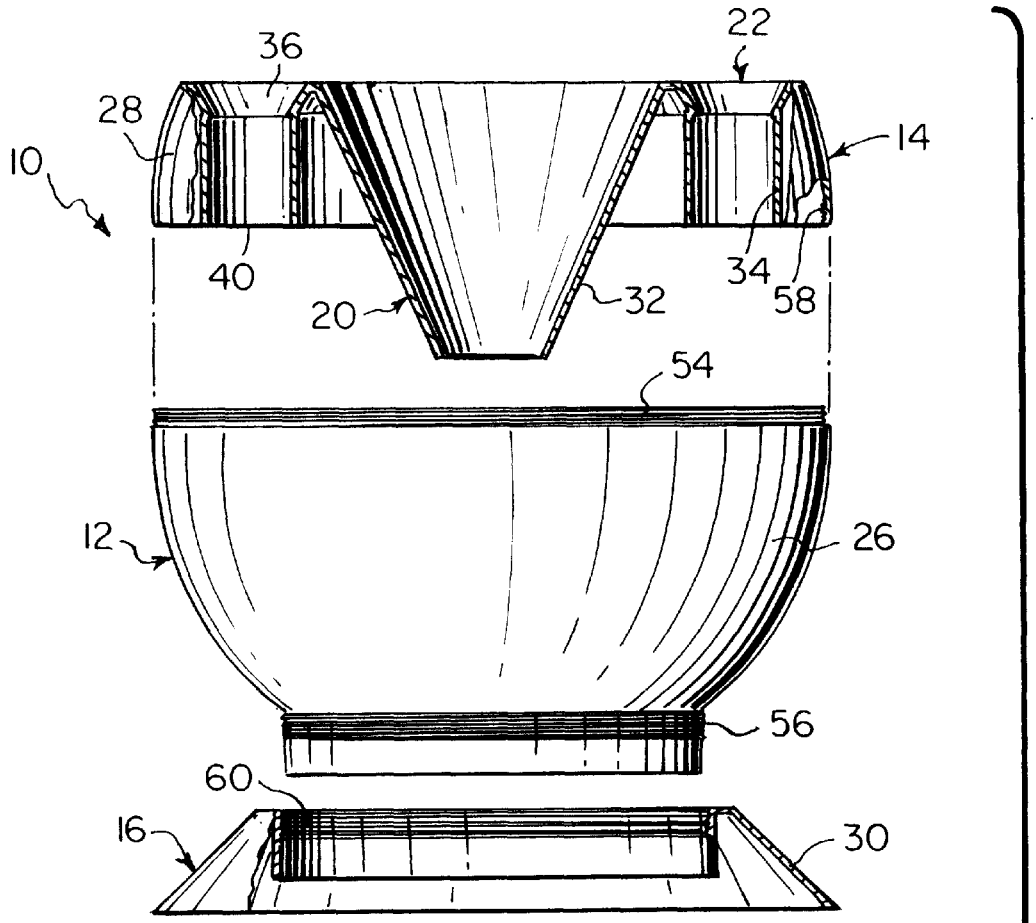
FIG. 3 is an exploded elevational view of the present invention per se, with parts broken away and in section.
Figure 4:
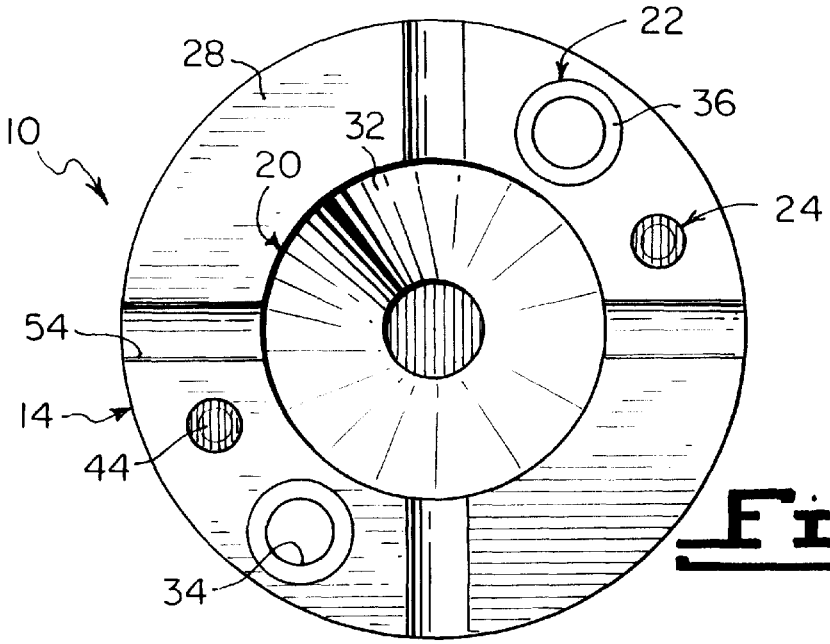
FIG. 4 is a top view taken in the direction of arrow 4 in FIG. 2.

Turning now descriptively to the drawings, in which similar reference characters denote similar elements throughout the several views, FIGS. 1 through 5 illustrate the present invention being a windproof ashtray 10. With regard to the reference numerals used, the following numbering is used throughout the various drawing figures.

| | |
|---|---|
| 10 | windproof ashtray |
| 12 | main body of 10 |
| 14 | top portion of 10 |
| 16 | base of 10 |
| 18 | support surface |
| 20 | ash guiding structure of 10 |
| 22 | cigarette extinguishing facility of 10 |
| 24 | cigarette butt depositing mechanism of 10 |
| 26 | cup shaped receptacle for 12 |
| 28 | donut shaped cover for 14 |
| 30 | truncated conical stand for 16 |
| 32 | central funnel of 20 in 14 |
| 34 | heat resistant pipe of 22 in 14 |
| 36 | tapered mouth of 34 |
| 38 | release assembly for 24 |
| 40 | open bottom end of 34 |
| 42 | stationary arm of 38 |
| 44 | spring biased push button of 38 |
| 46 | movable arm of 44 |
| 48 | plate |
| 50 | first lug on 48 |
| 52 | second lug on 48 |
| 54 | externally threaded upper collar on 12 |
| 56 | externally threaded lower collar on 12 |
| 58 | internally threaded lower end on 14 |
| 60 | internally threaded top inner collar on 16 |

The windproof ashtray 10 comprises a main body 12 for receiving cigarette ashes and cigarette butts therein. A top portion 14 is on the main body 12. A base 16 is for stabilizing the main body 12 upon a support surface 18. A structure 20 in the top portion 14 is for guiding cigarette ashes deposited therein into the main body 12, while preventing the cigarette ashes from being blown out.

The windproof ashtray 10 further includes a facility 22 for extinguishing a burning end of a cigarette. The windproof ashtray 10 also further contains a mechanism 24 for depositing the cigarette butt into the main body 12.

The main body 12 is a cup shaped receptacle 26. The top portion 14 is a donut shaped cover 28. The base 16 is a truncated conical stand 30.

The ash guiding structure 20 is a central funnel 32 in the top portion 14 extending downwardly into the main body 12. The cigarette extinguishing facility 22 is at least one heat resistant pipe 34, having a tapered mouth 36 extending downwardly in the top portion 14. The cigarette butt depositing mechanism 24 is at least one release assembly 38 in the top portion 14 covering an open bottom end 40 of the at least one heat resistant pipe 34.

Figure 5:
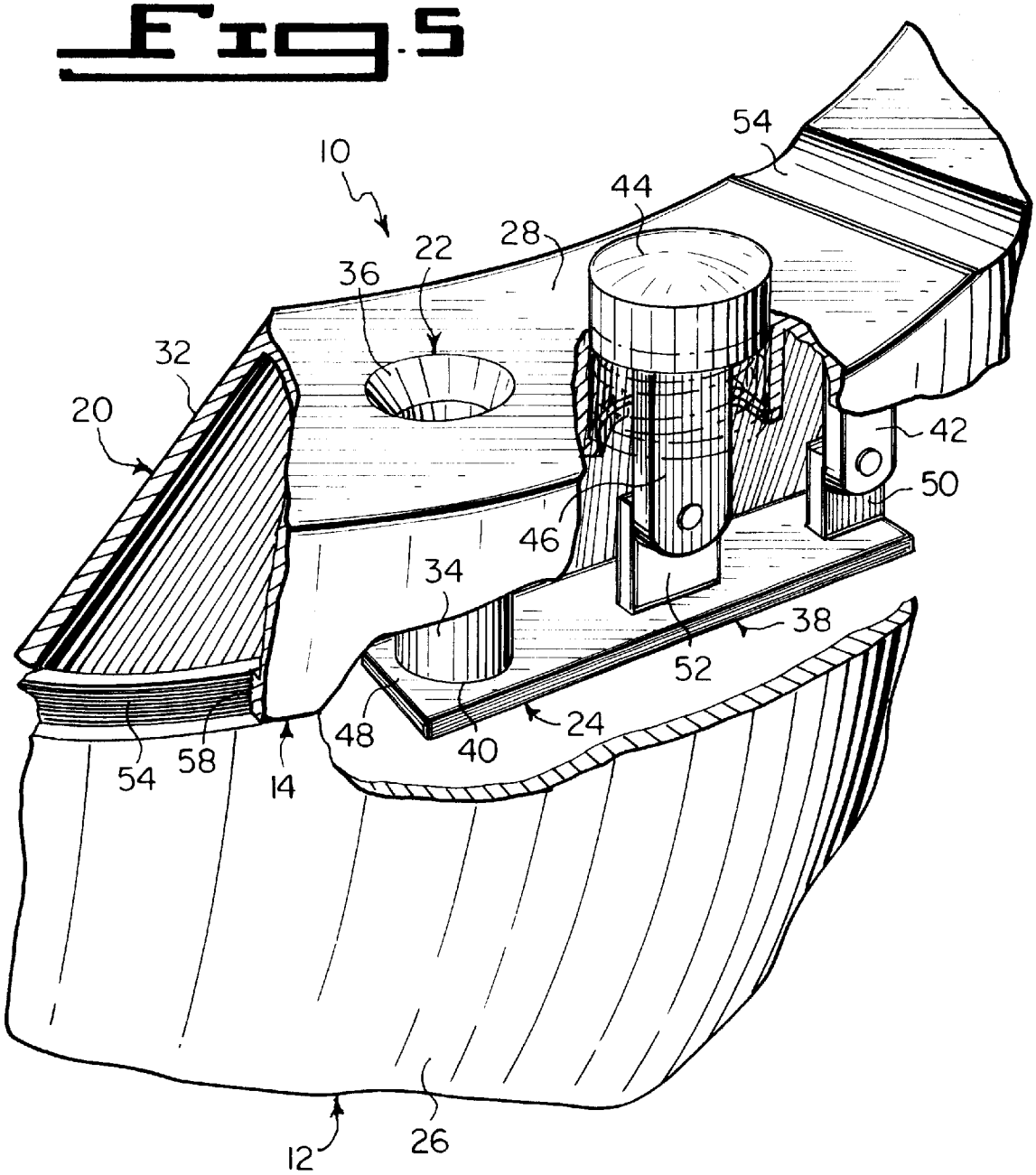
FIG. 5 is an enlarged partial perspective view of the present invention with parts broken away and in section, showing the cigarette butt release assembly therein.

The at least one release assembly 38, as shown in FIG. 5, includes a stationary arm 42 extending downwardly in the top portion 14. A spring biased push button 44 in the top portion 14 has a movable arm 46 extending downwardly in the top portion 14 adjacent to the stationary arm 42. A plate 48 has a pair of spaced apart upstanding lugs 50 and 52. The first lug 50 is pivotal on the stationary arm 42, while the second lug 52 is pivotal on the movable arm 46. The plate 48 normally covers the open bottom end 40 of the at least one heat resistant pipe 34. When the push button 44 is manually pressed down, the plate 48 will pivot away from the open bottom end 40 of the at least one heat resistant pipe 34 to allow the cigarette butt to drop into the main body 12. At least one concave groove 54 extends across the top portion 14 to the central funnel 32, to hold a lighted cigarette therein over the central funnel 32, so that the ashes can drop into the central funnel 32 to go into the main body 12.

The top portion 14 and the base 16 are separable from the main body 12. The main body 12 has an externally threaded upper collar 54 and an externally threaded lower collar 56. The top portion 14 has an internally threaded lower end 58 which threads onto the externally threaded upper collar 54 on the main body 12. The base 16 has an internally threaded top inner collar 60, which threads onto the externally threaded lower collar 56 on the main body 12.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A windproof ashtray comprising:

a) a main body for receiving cigarette ashes and cigarette butts therein;

b) a top portion on said main body;

c) a base for stabilizing said main body upon a support surface;

d) means in said top portion for guiding cigarette ashes deposited therein into said main body, while preventing the cigarette ashes from being blown out;

e) means for extinguishing a burning end of a cigarette including at least one heat resistant pipe having a tapered mouth extending downwardly in said top portion; and f) means for depositing the cigarette butt into said main body including at least one release assembly in said top portion covering an open bottom end of said at least one heat resistant pipe, said release assembly including:

i) a stationary arm extending downwardly in said top portion;

ii) a spring biased push button in said top portion having a movable arm extending downwardly in said top portion adjacent to said stationary arm; and iii) a plate having a pair of spaced apart upstanding lugs, wherein said first lug is pivotal on said stationary arm, while said second lug is pivotal on said movable arm, said plate normally covers said open bottom end of said at least one heat resistant pipe, so that when said push button is manually pressed down, said plate will pivot away from said open bottom end of said at least one heat resistant pipe to allow the cigarette butt to drop into said main body.

2. A windproof ashtray as recited in claim 1, wherein said main body is a cup shaped receptacle.

3. A windproof ashtray as recited in claim 2, wherein said top portion is a donut shaped cover.

4. A windproof ashtray as recited in claim 3, wherein said base is a truncated conical stand.

5. A windproof ashtray as recited in claim 4, wherein said guiding means is a central funnel in said top portion extending downwardly into said main body.

6. A windproof ashtray as recited in claim 5, further including at least one concave groove extending across said top portion to said central funnel to hold a lighted cigarette therein over said central funnel, so that the ashes can drop into said central funnel to go into said main body.

7. A windproof ashtray as recited in claim 6, wherein said top portion and said base are separable from said main body and include:

a) said main body having an externally threaded upper collar and an externally threaded lower collar;

b) said top portion having an internally threaded lower end which threads onto said externally threaded upper collar on said main body; and c) said base having an internally threaded top inner collar which threads onto said externally threaded lower collar on said main body.

8. A windproof ashtray as recited in claim 1, wherein said top portion is a donut shaped cover.

9. A windproof ashtray as recited in claim 1, wherein said base is a truncated conical stand.

10. A windproof ashtray as recited in claim 1, wherein said guiding means is a central funnel in said top portion extending downwardly into said main body.

11. A windproof ashtray as recited in claim 10, further including at least one concave groove extending across said top portion to said central funnel to hold a lighted cigarette therein over said central funnel, so that the ashes can drop into said central funnel to go into said main body.

12. A windproof ashtray as recited in claim 1, wherein said top portion and said base are separable from said main body and include:

a) said main body having an externally threaded upper collar and an externally threaded lower collar;

b) said top portion having an internally threaded lower end which threads onto said externally threaded upper collar on said main body; and c) said base having an internally threaded top inner collar which threads onto said externally threaded lower collar on said main body.

* * * * *